US008935887B2

(12) United States Patent
Cavalcante

(10) Patent No.: US 8,935,887 B2
(45) Date of Patent: Jan. 20, 2015

(54) LINEAR ACTUATOR PARTICULARLY FOR SLIDING DOORS AND FOR SLIDING DOORS AND WINDOWS IN GENERAL

(75) Inventor: Toni Cavalcante, Deuville (IT)

(73) Assignee: Topp S.p.A. a Socio Unico, Sandrigo (IT)

( * ) Notice: Subject to any disclaimer, the term of this patent is extended or adjusted under 35 U.S.C. 154(b) by 0 days.

(21) Appl. No.: 13/474,198

(22) Filed: May 17, 2012

(65) Prior Publication Data

US 2012/0297683 A1 Nov. 29, 2012

(30) Foreign Application Priority Data

May 23, 2011 (IT) ..... PD2011A0162

(51) Int. Cl.
*E05F 11/34* (2006.01)
*E05F 15/14* (2006.01)

(52) U.S. Cl.
CPC ..... *E05F 15/142* (2013.01); *E05Y 2201/702* (2013.01); *E05Y 2201/722* (2013.01); *E05Y 2900/132* (2013.01)
USPC ..... 49/362; 49/360; 49/404

(58) Field of Classification Search
CPC ..... E05F 15/14; E05F 15/142; E05F 15/148; E05F 11/40; E05F 11/42
USPC ..... 49/360, 362, 404
See application file for complete search history.

(56) References Cited

U.S. PATENT DOCUMENTS

| | | | | |
|---|---|---|---|---|
| 2,047,850 | A * | 7/1936 | Belch | 49/190 |
| 4,188,752 | A * | 2/1980 | Monot | 49/218 |
| 4,541,202 | A * | 9/1985 | Dockery | 49/362 |
| 5,355,624 | A * | 10/1994 | Bacon | 49/280 |
| 5,422,552 | A * | 6/1995 | Parisi | 318/466 |
| 5,515,650 | A * | 5/1996 | Machill | 49/362 |
| 5,634,298 | A * | 6/1997 | Slopack | 49/360 |
| 2001/0027621 | A1* | 10/2001 | Davies et al. | 49/360 |
| 2002/0157318 | A1* | 10/2002 | Teubert et al. | 49/360 |
| 2004/0187390 | A1* | 9/2004 | Celani | 49/360 |
| 2006/0150520 | A1 | 7/2006 | Hamazaki | |
| 2008/0163553 | A1* | 7/2008 | Liao | 49/362 |
| 2012/0023827 | A1* | 2/2012 | Hancock et al. | 49/360 |
| 2012/0255232 | A1* | 10/2012 | Gayhart | 49/360 |

FOREIGN PATENT DOCUMENTS

| | | | |
|---|---|---|---|
| EP | 1325996 | A2 | 7/2003 |
| EP | 1672151 | A2 | 6/2006 |
| EP | 2206869 | A1 | 7/2010 |

OTHER PUBLICATIONS

European Search Report for EP12167423 dated Jul. 20, 2012.
Search Report Prepared for ITPD20110162 Dated January 9, 2012.

* cited by examiner

*Primary Examiner* — Katherine Mitchell
*Assistant Examiner* — Abe Massad
(74) *Attorney, Agent, or Firm* — Lando & Anastasi, LLP

(57) ABSTRACT

A linear actuator, particularly for sliding doors and for sliding doors and windows in general, comprising a supporting body, to be fixed by corresponding fixing elements between the two jambs of a door or of a door or window frame, motor drive elements being accommodated and fixed within the supporting body and being adapted for the rotation of a driving gear, which is intended to mesh with a driven rack, which in turn is fixed to a leaf of the door to be moved in translation.

7 Claims, 3 Drawing Sheets

LINEAR ACTUATOR PARTICULARLY FOR SLIDING DOORS AND FOR SLIDING DOORS AND WINDOWS IN GENERAL

The present invention relates to a linear actuator, particularly for sliding doors and for sliding doors and windows in general.

BACKGROUND OF THE INVENTION

Nowadays, in the field of home automation and of automation of habitable spaces in general, the use is increasing of actuators for opening and closing internal doors.

The automation of moving doors that can slide, known as slideaway doors, is however today still not common, since such slideaway doors are normally installed so as to be manually moved, and a subsequent mounting of actuation means in order to automate the translational motion of the door leaf is relatively complex and inconvenient.

Such subsequent mounting requires in fact the removal of the jamb of the door for the mounting of parts of the actuation mechanism to be fixed to the leaf, as well as the addition of a box-like body to contain the actuation means, the latter being supported inside the box-like body by a metallic cross-member that constitutes the supporting structure for the actuator itself, to be arranged at the upper edge of the leaf after specific cutting to measure.

The box-like body and structural cross-member, in addition to representing a cost in their own right, exhibit the drawback of needing to be cut to measure according to the space of the door to which they are to be applied.

Moreover, conventional linear actuators for moving doors are of the toothed-belt type, and therefore relatively complex, and thus they require excessive amounts of time for mounting. Such belt actuators exhibit the further disadvantages of not offering particular precision in the movement of the door leaf, not being usable for particularly heavy door leaves, since the power that can be transmitted via belt is generally limited, and not ensuring a continuous and stable movement for the door leaf.

SUMMARY OF THE INVENTION

The aim of the present invention is to provide a linear actuator structure, particularly for sliding doors and for sliding doors and windows in general, that makes it possible to eliminate the typical drawbacks of comparable conventional linear actuators for sliding doors.

Within this aim, an object of the invention is to provide a linear actuator that is capable of transmitting power so as to provide a translational motion of the door leaf that is continuous and stable even for particularly heavy door leaves.

Another object of the invention is to provide a linear actuator that is capable of being easily adapted to any width of the opening of the door with which it is intended to be used.

Another object of the invention is to provide a linear actuator that is compact and easily applied, even for a person with no specialist training.

A further object of the invention is to provide a linear actuator that is easy to assemble.

Another object of the invention is to provide a linear actuator particularly for sliding doors and for sliding doors and windows in general, that can be made using known systems and technologies.

This aim and these and other objects which will become better apparent hereinafter are achieved by a linear actuator, particularly for sliding doors and for sliding doors and windows in general, characterized in that it comprises a supporting body, to be fixed by corresponding fixing means between the two jambs of a door or of a door or window frame, motor drive means being accommodated and fixed within said supporting body and being adapted for the rotation of a driving gear, which is intended to mesh with a driven rack, which in turn is fixed to a leaf of the door to be moved in translation.

BRIEF DESCRIPTION OF THE DRAWINGS

Further characteristics and advantages of the invention will become better apparent from the description of a preferred, but not exclusive, embodiment of the linear actuator according to the invention, which is illustrated by way of non-limiting example in the accompanying drawings wherein.

DESCRIPTION OF THE PREFERRED EMBODIMENTS

Figure 1:
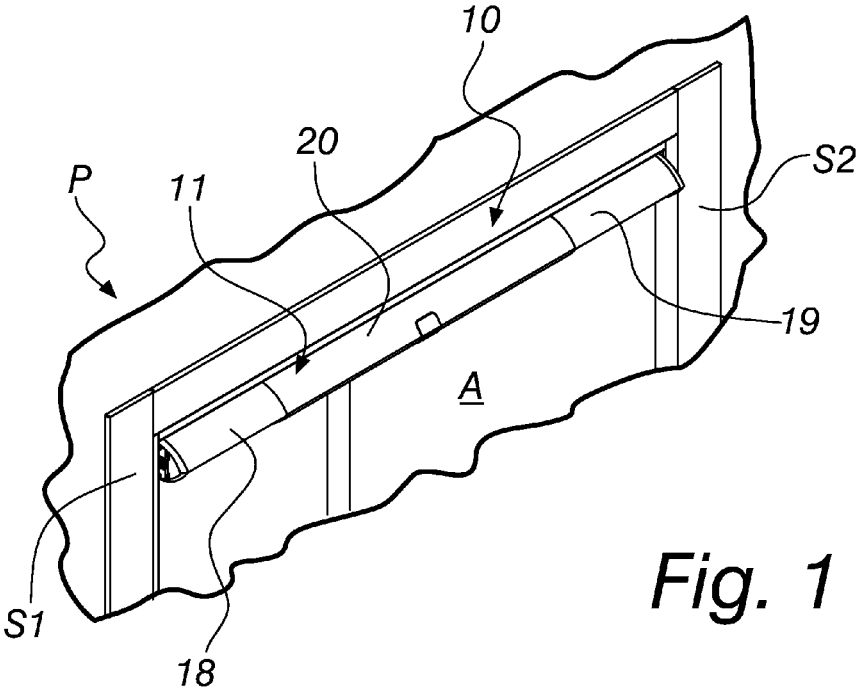
FIG. 1 is a perspective view of an actuator according to the invention, applied to a sliding door.
Figure 2:
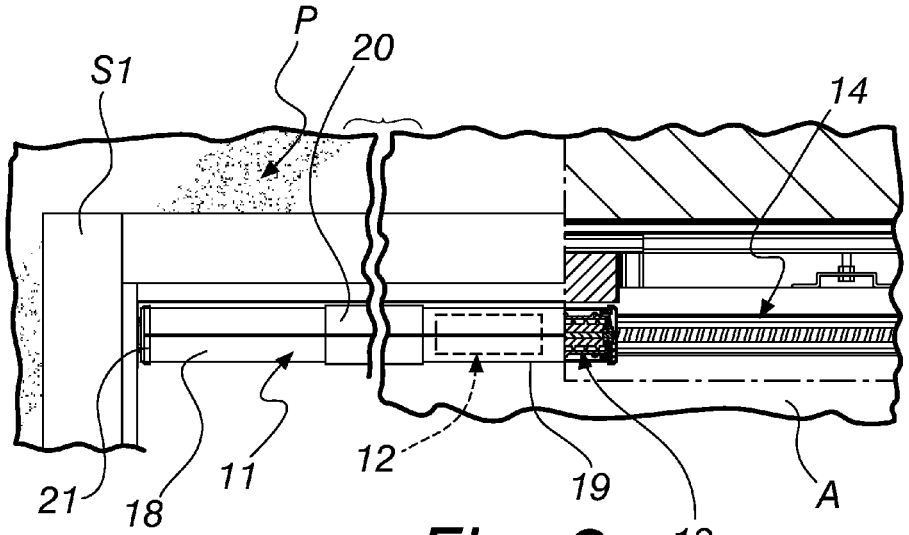
FIG. 2 is a partially sectional front view of the actuator according to the invention.
Figure 3:
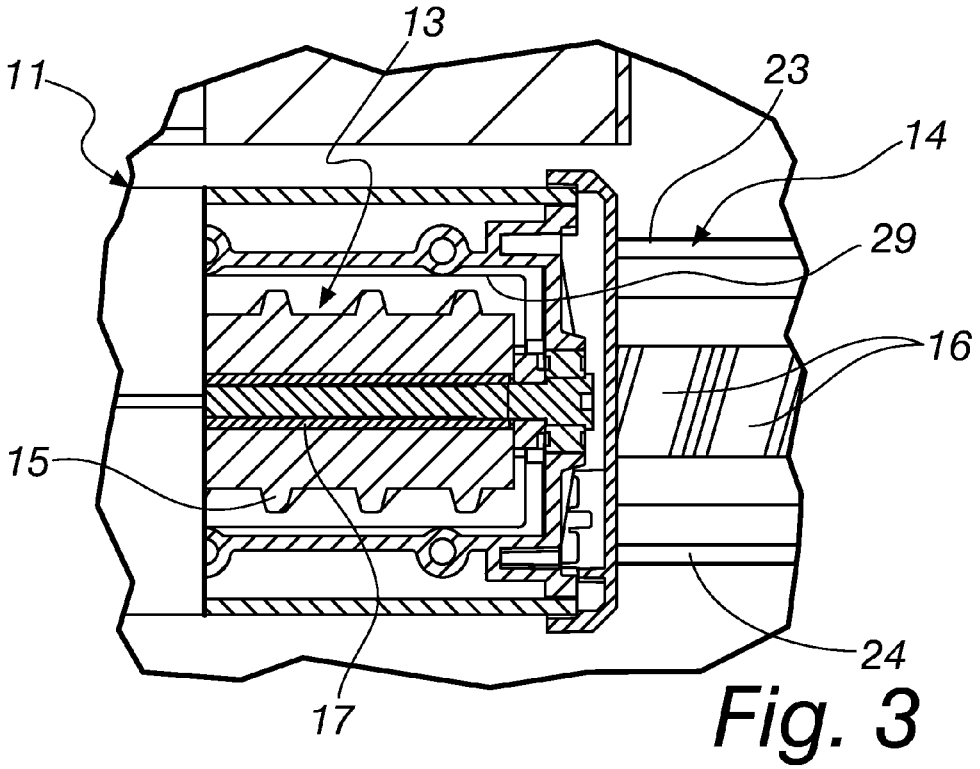
FIG. 3 is a sectional view of a detail of the front view in FIG. 2 of the actuator according to the invention.
Figure 4:
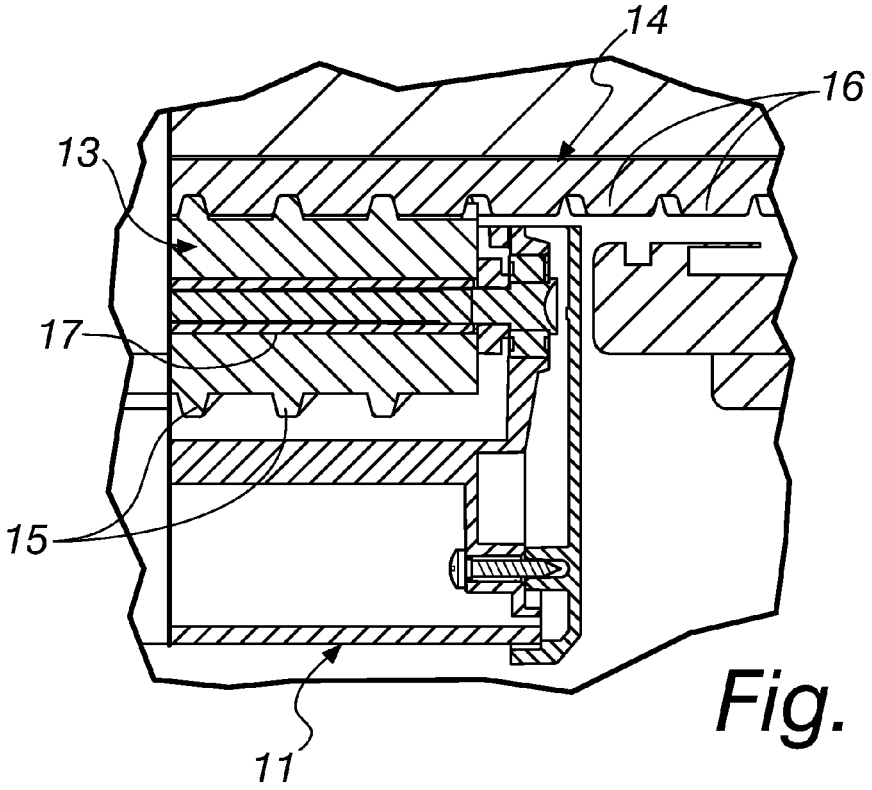
FIG. 4 is a sectional view from above of the same detail in FIG. 3.

With reference to the figures, a linear actuator particularly for sliding doors and for sliding doors and windows in general is generally designated with the reference numeral 10.

The linear actuator 10 comprises a supporting body 11, to be fixed by corresponding fixing means, which shall be better described below, between the two jambs S1, S2 of a door P or of a door or window frame in general.

Accommodated on the supporting body 11 are motor drive means 12, which are fixed and adapted for the rotation of a driving gear 13, which is intended to mesh with a driven rack 14, which in its turn is fixed to a leaf A, of the door P, to be moved in translation.

The driving gear 13 is constituted by an endless screw, the thread 15 of which is adapted to engage between the oblique teeth 16 of the rack 14.

The motor drive means 12 are constituted by an electric motor the drive shaft of which actuates the shaft 17, with the interposition of intermediate transmission means or without, which supports the endless screw, i.e. the driving gear 13.

The intermediate transmission means, which are not shown for the sake of simplicity and which should be understood as being of known type, can be provided by a cascade of gearwheels, or by a belt, or other means that are similar and equivalent.

The supporting body 11 is substantially tubular.

Advantageously, the supporting body 11 is telescopic, due to the extractability of two opposite lateral portions 18 and 19 thereof, with respect to the central part 20.

The telescopic nature of the supporting body 11 makes it adaptable to doors with passage openings of different width.

Figure 5:
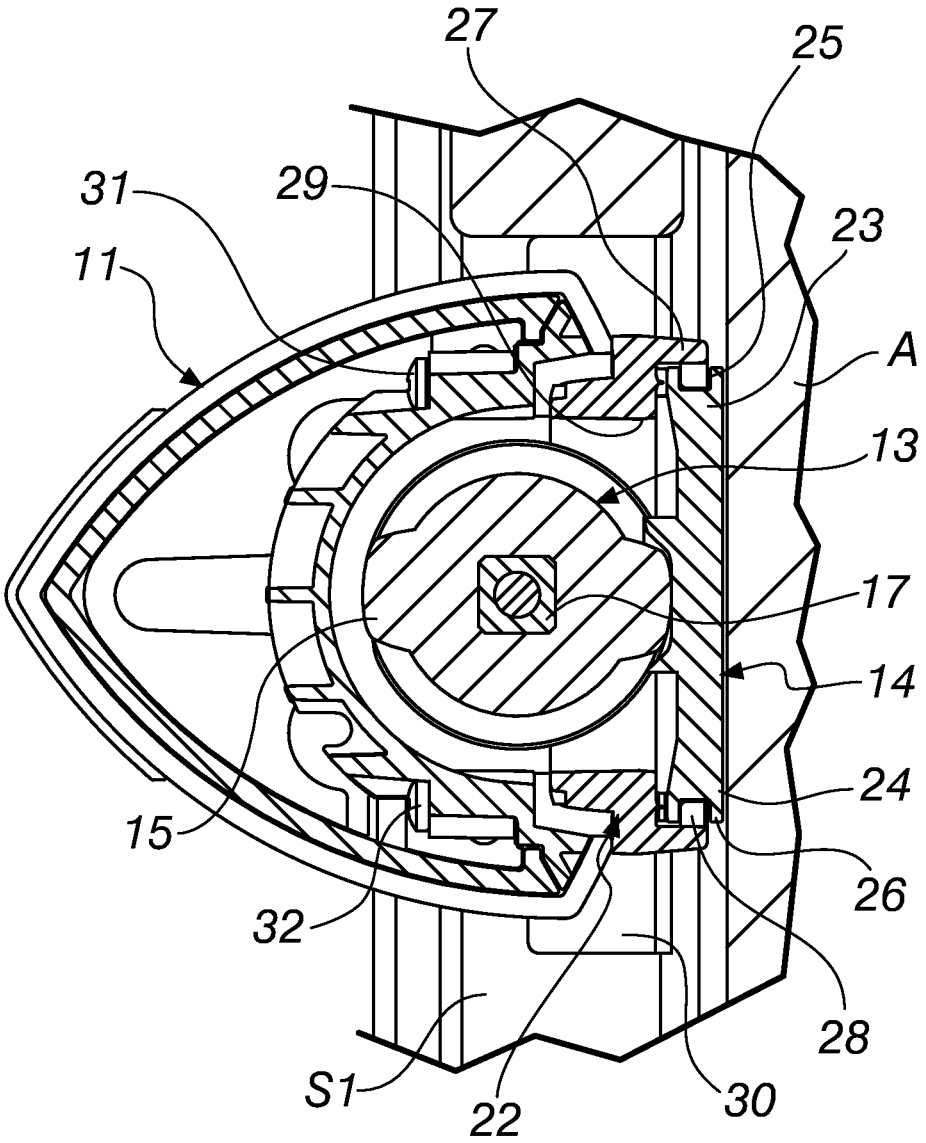
FIG. 5 is a transverse cross-section of the actuator according to the invention.

The supporting body 11 is fixed at one end to a jamb S1 by means of a metallic bracket 30 and corresponding threaded elements for fixing to the jamb and to the lateral cover 21 of the supporting body 11, and at the opposite end by means of a slider 22, clearly visible in FIG. 5, which is coupled so as to slide on the rack 14.

The rack 14 is fixed to the door leaf A, by being glued, or by way of threaded connections not shown for the sake of simplicity.

The rack 14 has, at its long sides 23 and 24, longitudinal grooves 25 and 26 respectively, which are adapted to accommodate the engagement and sliding tabs 27 and 28 that protrude from the slider 22.

The slider 22 is fixed to the supporting body at the driving gear 13, and has an opening 29 adapted to allow the engagement of the thread of the driving gear 13 with the rack 14.

The fixing of the slider 22 to the supporting body 11 occurs for example by way of screws 31 and 32, two heads of which are visible in FIG. 5.

Operation of the linear actuator 10 according to the invention is the following.

Once the rack 14 is fixed to the door leaf A, and the supporting body 11, adjusted to measure, is coupled to a jamb S1 at one end, and the slider 22 is inserted on the rack 14 at the opposite end, the driving gear 13 engages with the rack 14 and the actuator is ready to be used.

The electric motor can be powered by way of a mains connection, or, optionally, by batteries.

The rotation of the endless screw determines the translational motion of the rack 14 and, with it, of the door leaf A.

The correct meshing of the thread of the endless screw with the teeth of the rack 14 is ensured by the engagement of the slider 22 on the longitudinal grooves 25 and 26.

In practice it has been found that the invention fully achieves the intended aim and objects.

In particular, with the invention a linear actuator has been devised which thanks to the lateral parts that can be telescopically slid out from the central part is capable of being easily adapted to any width of the opening of the door with which it is intended to be used.

Also, with the invention a linear actuator has been devised which, by means of the gearwheel transmission, is capable of transmitting power so as to provide a translational motion of the door leaf that is continuous and stable even for particularly heavy door leaves.

Moreover, with the invention a linear actuator has been provided that is compact and easily applied, even for a person with no specialist training, thanks to the ease of installation described above.

Moreover, with the invention a linear actuator has been provided that is easy to assemble.

Moreover, with the invention a linear actuator has been provided that can be applied to leaves of doors and to window blinds, in an upper position or in a lower position or countersunk in a floor for a door or in a wall for a window.

Last but not least, with the invention a linear actuator particularly for sliding doors has been devised which can be made using known systems and technologies.

The invention, thus conceived, is susceptible of numerous modifications and variations, all of which are within the scope of the appended claims. Moreover, all the details may be substituted by other, technically equivalent elements.

In practice the materials employed, as well as the contingent dimensions and shapes, may be any according to requirements and to the state of the art.

The disclosures in Italian Patent Application No. PD2011A000162 from which this application claims priority are incorporated herein by reference.

What is claimed is:

1. A linear actuator, for sliding doors and for sliding windows, comprising a supporting body, a motor drive accommodated and fixed within said supporting body, a driving gear adapted to be rotated within said supporting body by said motor drive about a rotation axis, and a driven rack, adapted to be fixed to a sliding leaf, and having a longitudinal axis and being coupled to mesh with said driving gear such that said rotation axis of said driving gear extends parallel to said longitudinal axis of said driven rack, said driving gear being constituted by an endless screw, a thread of which engages between oblique teeth of said driven rack, and said supporting body being substantially tubular and telescopic in a direction that is parallel to said longitudinal axis of said driven rack and to said rotation axis of said driving gear, said supporting body being configured to substantially cover the driven rack when fully extended, and a slider, said slider being fixed to said supporting body and configured to slide on said driven rack, wherein said rack has, at lateral long sides thereof, respective longitudinal grooves arranged laterally to said oblique teeth of said rack, which accommodate engagement and sliding tabs that protrude from the slider into said longitudinal grooves.

2. The linear actuator according to claim 1, wherein said motor drive is constituted by an electric motor having a driving shaft, which supports the driving gear.

3. The linear actuator according to claim 1, wherein said supporting body comprises a central part and at least one lateral portion which is extractable with respect to said central part.

4. A linear actuator arranged in a sliding door or sliding window, comprising a supporting body, a motor drive accommodated and fixed within said supporting body, a driving gear adapted to be rotated within said supporting body by said motor drive about a rotation axis, a driven rack, fixed to a sliding leaf of said sliding door or sliding window, and having a longitudinal axis and being arranged meshing with said driving gear such that said rotation axis of said driving gear extends parallel to said longitudinal axis of said driven rack, said driving gear being constituted by an endless screw, a thread of which engages between oblique teeth of said driven rack, and said supporting body being substantially tubular and telescopic in a direction that is parallel to said longitudinal axis of said driven rack and to said rotation axis of said driving gear, said supporting body being configured to substantially cover the driven rack when fully extended, said supporting body being fixed at one end to a jamb of said sliding door or sliding window, and said supporting body being fixed at an opposite end by means of a slider, which is coupled so as to slide on the rack, wherein said rack has, at lateral long sides thereof, respective longitudinal grooves arranged laterally to said oblique teeth of said rack, which accommodate engagement and sliding tabs that protrude from the slider into said longitudinal grooves.

5. The linear actuator in the sliding door or the sliding window according to claim 4, wherein said rack is fixed to said sliding leaf by being glued or by means of threaded connections.

6. The linear actuator in the sliding door or the sliding window according to claim 4, wherein said slider is fixed to the supporting body at the driving gear and has an opening adapted to allow the engagement of the thread of said driving gear with the rack.

7. The linear actuator according to claim 1, wherein said slider is fixed to the supporting body by means of screws.

* * * * *